US011183347B2

(12) United States Patent
Hsieh et al.

(10) Patent No.: US 11,183,347 B2
(45) Date of Patent: Nov. 23, 2021

(54) KEYBOARD

(71) Applicant: Chicony Electronics Co., Ltd., New Taipei (TW)

(72) Inventors: Chao-Chin Hsieh, New Taipei (TW); Chun-Chieh Chan, New Taipei (TW)

(73) Assignee: Chicony Electronics Co., Ltd., New Taipei (TW)

( * ) Notice: Subject to any disclaimer, the term of this patent is extended or adjusted under 35 U.S.C. 154(b) by 0 days.

(21) Appl. No.: 16/737,915

(22) Filed: Jan. 9, 2020

(65) Prior Publication Data

US 2020/0402742 A1 Dec. 24, 2020

(30) Foreign Application Priority Data

Jun. 19, 2019 (TW) ..... 108121354

(51) Int. Cl.
*H01H 3/12* (2006.01)
*H01H 13/705* (2006.01)
*H01H 13/14* (2006.01)

(52) U.S. Cl.
CPC ..... *H01H 13/705* (2013.01); *H01H 13/14* (2013.01)

(58) Field of Classification Search
CPC ..... H01H 3/125; H01H 13/83; H01H 13/705; H01H 13/14; H01H 13/70; H01H 2221/062; H01H 2221/026; H01H 9/26; H01H 13/72; H01H 25/00; H01H 25/04; H01H 1/02
See application file for complete search history.

(56) References Cited

U.S. PATENT DOCUMENTS 9,959,992 B1 * 5/2018 Chen ..... H01H 13/705
2015/0101916 A1 * 4/2015 Chen ..... H01H 3/125 200/5 A
2018/0350537 A1 * 12/2018 Liao ..... H01H 13/705

FOREIGN PATENT DOCUMENTS

TW M551337 U 11/2017

* cited by examiner

*Primary Examiner* — Ahmed M Saeed
(74) *Attorney, Agent, or Firm* — CKC & Partners Co., LLC

(57) ABSTRACT

A keyboard includes a base plate, a hook structure, and a plastic engaging member. The base plate has a top surface. The hook structure is connected to the base plate and raised relative to the top surface. The plastic engaging member is located on the top surface and fixed to at least a part of the hook structure.

18 Claims, 9 Drawing Sheets

KEYBOARD

CROSS-REFERENCE TO RELATED APPLICATION

This application claims priority to Taiwan Application Serial Number 108121354, filed Jun. 19, 2019, which is herein incorporated by reference.

BACKGROUND

Technical Field

The present disclosure relates to a keyboard.

Description of Related Art

For a keyswitch on a keyboard, in order to balance the force applied onto the keyswitch by a user, a kind of guiding connection structure is usually disposed under the keycap of the keyswitch, so as to guide the keycap to vertically move. As such, no matter being applied at an edge or a corner of the keycap, the force can be spread evenly across the entire surface of the keycap, which makes it easy to press the entire keyswitch and makes it easier for the user to operate the keyswitch.

In general, the foregoing guiding connection structure is often fixed in the keyboard by engaging with hooks formed on a bottom plate. A conventional method of manufacturing the bottom plate having the hooks is performing a stamping process to a metal sheet to form the bent and upright hooks. However, when engaging with the foregoing hooks, engaging portions of the guiding connection structure are retained between the hooks and the bottom plate. Therefore, the machining precision of bending the hooks will have a great impact on the assembly tolerance between the guiding connection structure and the hooks, which will often cause the keyswitch to shake and tilt. Moreover, the aforementioned bottom plate and guiding connection structure are generally made of metal material, so when the keyboard is used, noises of knocking metal are often generated.

In addition, under the current development trend of the keyboard towards light weight and thinning, the configuration of the conventional guiding connection structure with a metal bottom plate may not meet the demand. For example, if the thickness of the metal bottom plate is reduced in the foregoing configuration to meet the weight reduction requirement, the strength of the metal bottom plate is also reduced, which may result in failure to perform processing such as stamping and bending on the metal bottom plate. Even if it is carried out, it doesn't take into account mechanical strength.

Accordingly, how to provide a keyboard to solve the aforementioned problems becomes an important issue to be solved by those in the industry.

SUMMARY

An aspect of the disclosure is to provide a keyboard which can effectively solve the aforementioned problems.

According to an embodiment of the disclosure, a keyboard includes a base plate, a hook structure, and a plastic engaging member. The base plate has a top surface. The hook structure is connected to the base plate and raised relative to the top surface. The plastic engaging member is located on the top surface and fixed to at least a part of the hook structure.

In an embodiment of the disclosure, the base plate has a through hole running through the top surface. The hook structure adjoins the through hole.

In an embodiment of the disclosure, the plastic engaging member is partially extended into the through hole.

In an embodiment of the disclosure, the plastic engaging member is entirely located outside the through hole.

In an embodiment of the disclosure, the keyboard further includes another hook structure connected to the base plate and raised relative to the top surface. The plastic engaging member is further fixed to said another hook structure.

In an embodiment of the disclosure, said another hook structure adjoins the through hole. The hook structure and said another hook structure are located at opposite sides of the through hole respectively.

In an embodiment of the disclosure, the base plate further has another through hole running through the top surface. Said another hook structure adjoins said another through hole.

In an embodiment of the disclosure, the base plate further has a rib. The rib separates the through hole and said another through hole and supports the plastic engaging member.

In an embodiment of the disclosure, the hook structure is embedded in the plastic engaging member.

In an embodiment of the disclosure, the hook structure has a surface having a blocking portion. The blocking portion substantially faces the base plate. A part of the plastic engaging member is located between the blocking portion and the top surface.

In an embodiment of the disclosure, a normal line of the blocking portion passes through the top surface of the base plate and a virtual extension surface of the top surface.

In an embodiment of the disclosure, the base plate and the hook structure form two connected parts of a unitary structure.

In an embodiment of the disclosure, the top surface is flat.

In an embodiment of the disclosure, the hook structure is bended from the base plate.

In an embodiment of the disclosure, the keyboard further includes a keycap and a guiding connection structure. The keycap is located over the base plate. The guiding connection structure is engaged between the plastic engaging member and the keycap and configured to guide the keycap to move toward and away from the base plate.

Accordingly, in the keyboard of the present disclosure, the guiding connection structure is connected to the plastic engaging member disposed on the base plate, instead of being connected to the hooks on the metal bottom plate as used in the conventional keyboard. The plastic engaging member disposed on the base plate of the present disclosure can increase the structural strength of the base plate, so as to effectively avoid the problem of deformation of the base plate caused by pressing when assembling the guiding connection structure or pressing the keycap, thereby allowing the base plate to be further thinned to achieve the purpose of being light and thin. Moreover, the assembly tolerance between the plastic engaging member and the guiding connection structure can be controlled simply by the manufacturing precision of the plastic engaging member itself, and does not be deeply affected by the processing precision of bending the hooks as the conventional keyboard does, so the assembly precision of the keyboard of the present disclosure is improved.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1:
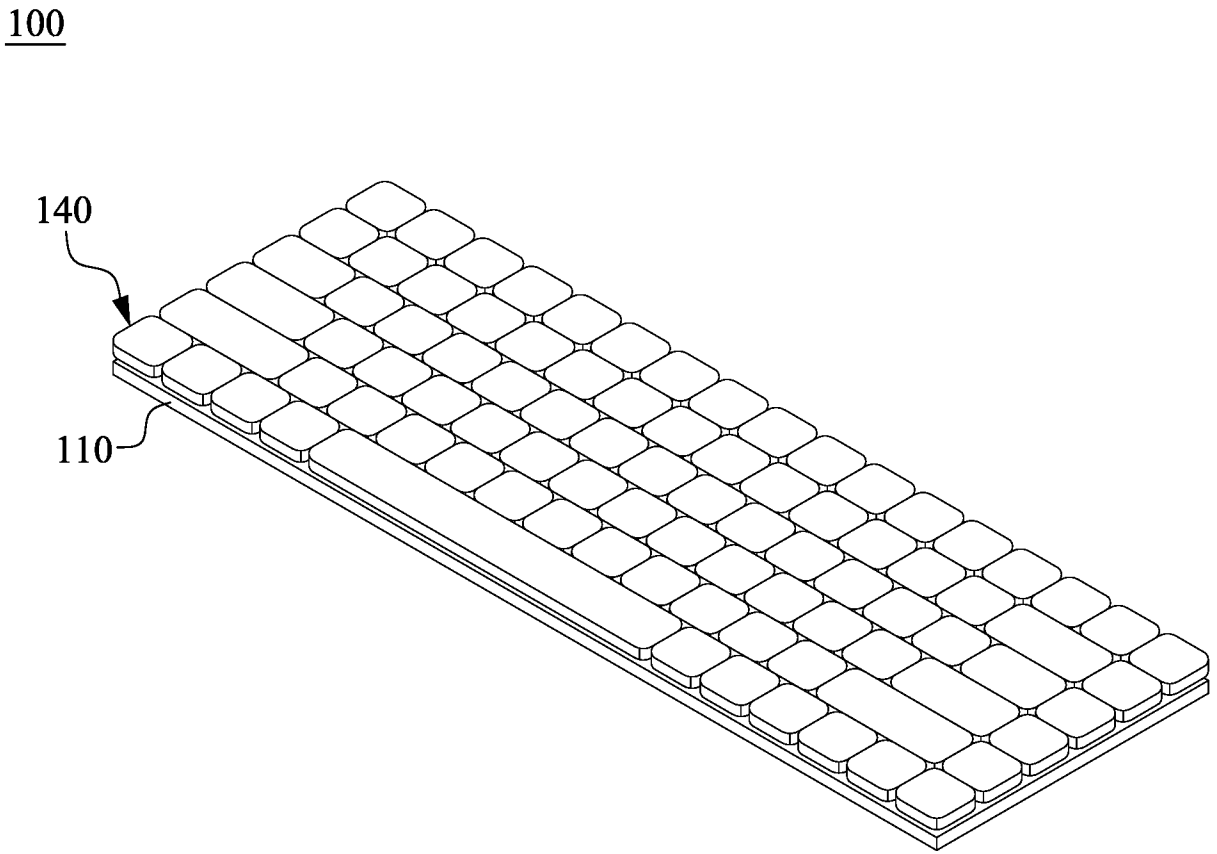
FIG. 1 is a perspective view of a keyboard according to an embodiment of the disclosure.

Reference will now be made in detail to the present embodiments of the disclosure, examples of which are illustrated in the accompanying drawings. Wherever possible, the same reference numbers are used in the drawings and the description to refer to the same or like parts. However, specific structural and functional details disclosed herein are merely representative for purposes of describing exemplary embodiments, and thus may be embodied in many alternate forms and should not be construed as limited to only exemplary embodiments set forth herein. Therefore, it should be understood that there is no intent to limit exemplary embodiments to the particular forms disclosed, but on the contrary, exemplary embodiments are to cover all modifications, equivalents, and alternatives falling within the scope of the disclosure.

Figure 2:
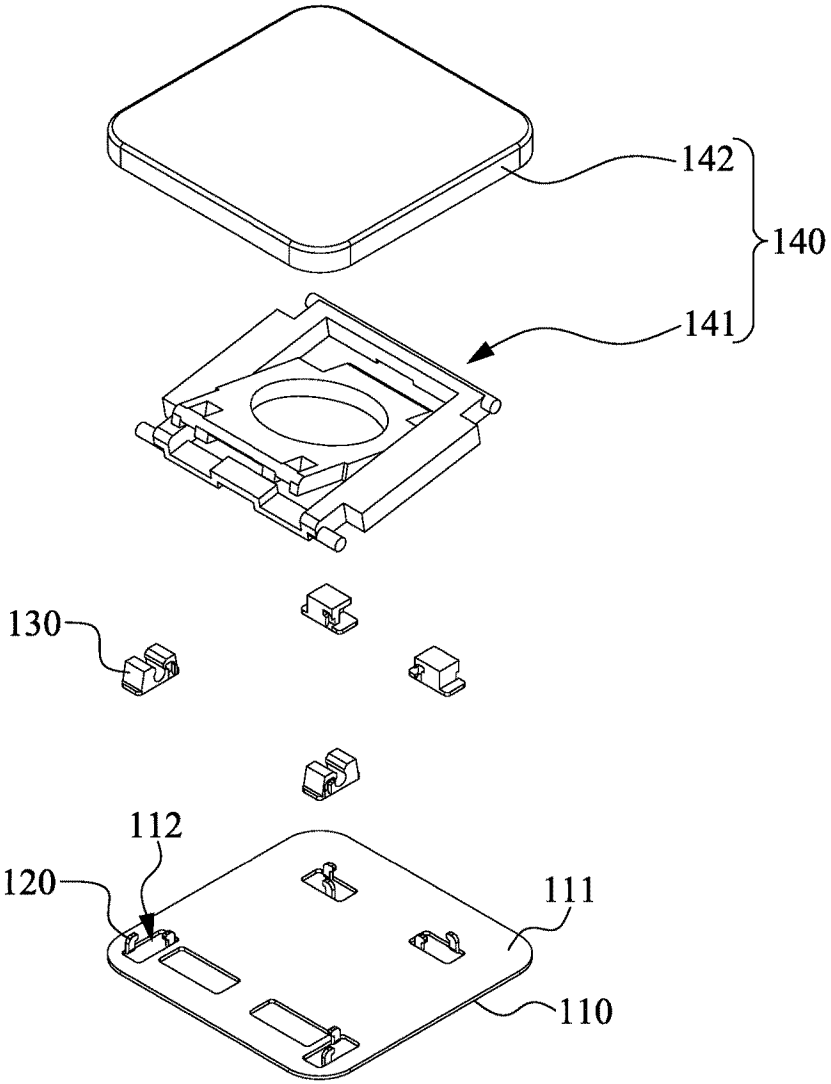
FIG. 2 is a partial exploded view of the keyboard according to an embodiment of the disclosure.

Reference is made to FIGS. 1 and 2. FIG. 1 is a perspective view of a keyboard 100 according to an embodiment of the disclosure. FIG. 2 is a partial exploded view of the keyboard 100 according to an embodiment of the disclosure. As shown in FIGS. 1 to 2, the keyboard 100 of the disclosure can be an external keyboard (e.g., a keyboard with a PS/2 interface or a keyboard with a USB interface) used in a desktop computer, or can be a part of a computer system having an input device (e.g., a touch pad on a notebook computer) that is in the form of a keyswitch, but the disclosure is not limited in this regard. That is, concepts of the keyboard 100 of the disclosure can be used in any electronic product that performs input function by pressing. In the present embodiment, the keyboard 100 includes a base plate 110, a plurality of hook structures 120 (only one of which is representatively labeled), a plurality of plastic engaging members 130 (only one of which is representatively labeled), and a plurality of keyswitch assemblies 140 (only one of which is representatively labeled), in which the base plate 110, four pairs of the hook structures 120, four of the plastic engaging members 130, and one of the keyswitch assemblies 140 can be regarded as a single keyswitch device.

Structures and functions of components included in the keyboard 100 and connection and action relationships among these components are introduced in detail below.

Figure 3A:
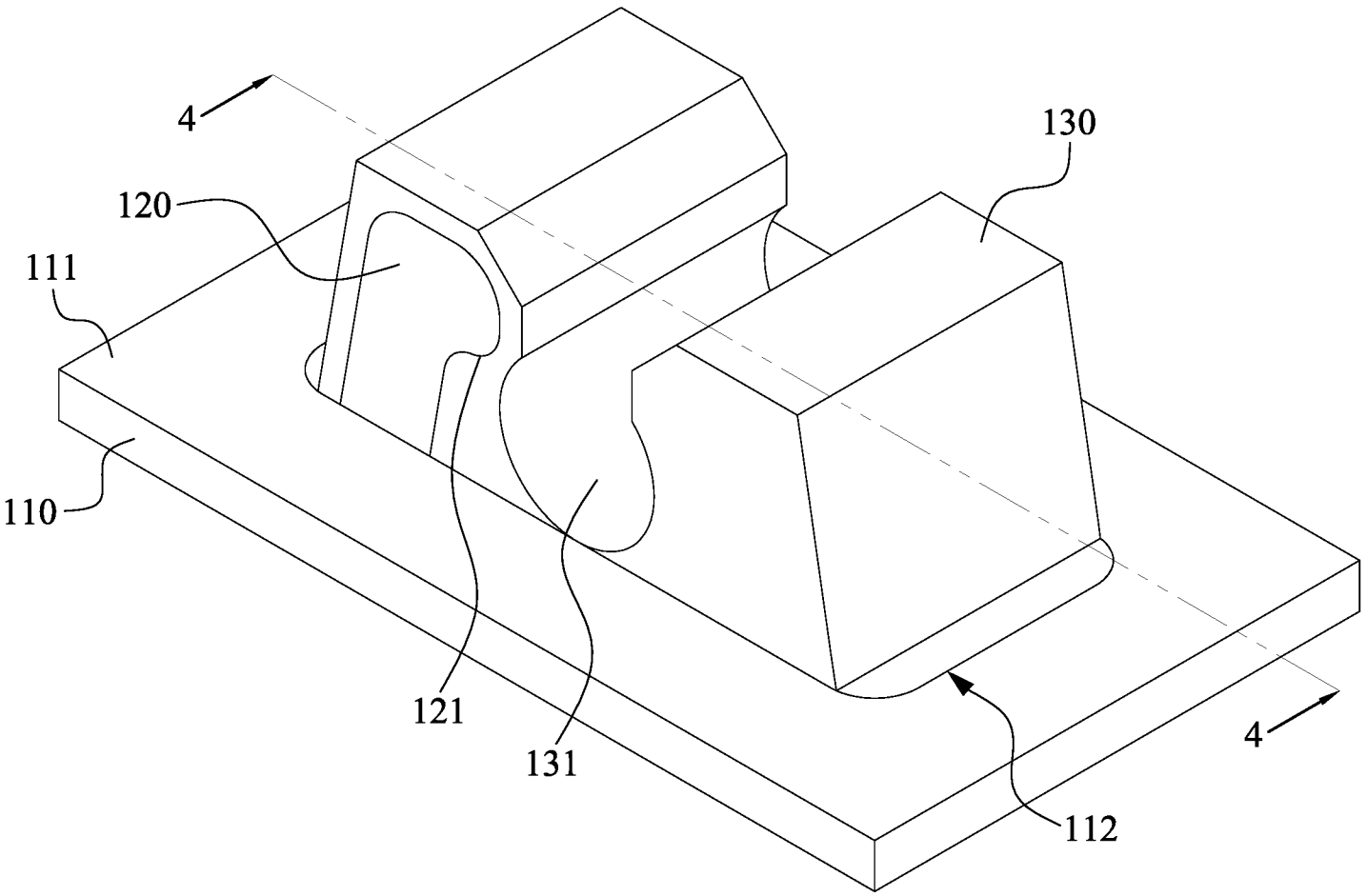
FIG. 3A is a perspective view of a part of a base plate, a hook structure, and a plastic engaging member according to an embodiment of the disclosure.
Figure 3B:
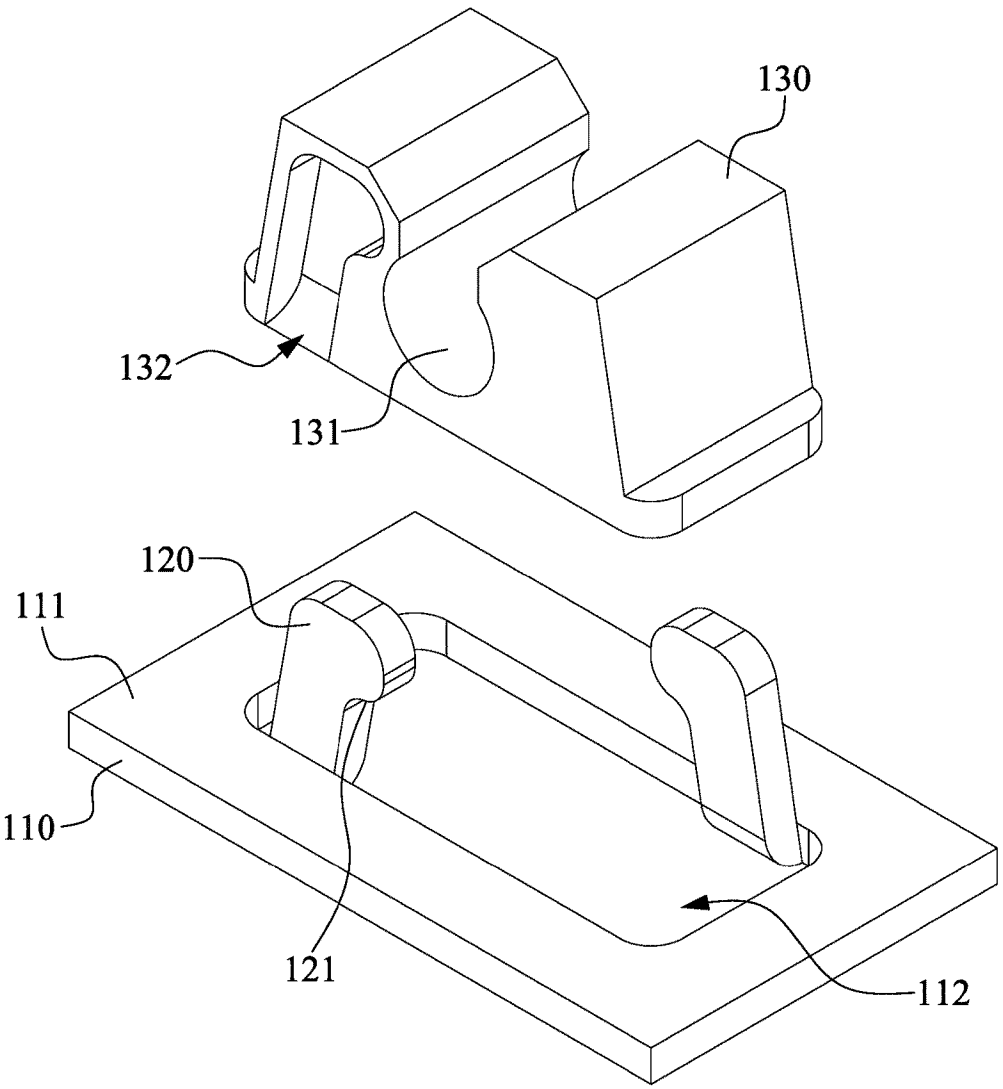
FIG. 3B is an exploded view of the structure shown in FIG. 3A.

Reference is made both to FIGS. 3A and 3B. FIG. 3A is a perspective view of a part of the base plate 110, the hook structures 120, and the plastic engaging member 130 according to an embodiment of the disclosure. FIG. 3B is an exploded view of the structure shown in FIG. 3A. As shown in FIGS. 2 to 3B, in the present embodiment, the base plate 110 has a top surface 111. The hook structures 120 are connected to the base plate 110 and raised relative to the top surface 111 of the base plate 110. The plastic engaging member 130 is located on the top surface 111 and fixed to at least a part of the hook structure 120. For example, the plastic engaging member 130 is formed on the hook structures 120 by, for example, an injection molding process, so that the plastic engaging member 130 abuts against the hook structures 120. The plastic engaging member 130 is fixed to at least a part of the hook structure 120, and they are firmly combined. The plastic engaging member 130 is retained by the hook structures 120 and fixedly disposed on the base plate 110. Furthermore, the plastic engaging member 130 can have at least one groove portion 132. At least a part of the hook structures 120 is disposed in the groove portion 132. The shape of the groove portion 132 corresponds to the shape of at least a part of the hook structures 120 (e.g., surfaces abutting against each other and respectively of which are complementary or conformal), so that at least a part of the hook structures 120 is embedded into the groove portion 132. At least a part of the hook structures 120 is surrounded and covered by the plastic engaging member 130. The keyswitch assembly 140 includes a guiding connection structure 141 and a keycap 142. The keycap 142 is located over the base plate 110. The guiding connection structure 141 is engaged between the plastic engaging member 130 and the keycap 142. The guiding connection structure 141 is configured to guide the keycap 142 to move toward and away from the base plate 110.

With the foregoing structural configuration, the way, used in the conventional keyboard, of connecting the hooks on the metal bottom plate to the guiding connection structure can be replaced. Specifically, the plastic engaging member 130 disposed on the base plate 110 of the present embodiment can increase the structural strength of the base plate 110, so as to effectively avoid the problem of deformation of the base plate 110 or the hook structure 120 caused by pressing when assembling the guiding connection structure 141 or pressing the keycap 142, thereby allowing the base plate 110 to be further thinned to achieve the purpose of making the keyboard 100 be light and thin. Moreover, the assembly tolerance between the plastic engaging member 130 and the guiding connection structure 141 can be controlled simply by the manufacturing precision of the plastic engaging member 130 itself, and does not deeply affected by the processing precision of bending the hooks as the conventional keyboard does, so the assembly precision of the keyboard of the present embodiment can be improved.

In the embodiment as shown in FIG. 2, the guiding connection structure141 is formed by pivotally connecting two linkages, but the disclosure is not limited in this regard. In practical applications, the guiding connection structure141 can be replaced by other structures having similar functions (i.e., moving the keycap 142 relative to the base plate 110), such as V-shaped linkage structures, A-shaped linkage structures, or linkage structures each has two parallel linkages.

In some embodiments, the keyboard 100 can further include a circuit board (not illustrated in the drawings). The circuit board can be disposed between the base plate 110 and the keyswitch assembly 140 and a keyswitch circuit is disposed thereon, so as to generate a corresponding keyswitch signal when the keycap 142 of the keyswitch assembly 140 is triggered. In some embodiment, the foregoing circuit board can be a rigid printed circuit board or a flexible circuit board, but the disclosure is not limited in this regard.

In some embodiments, the keyswitch assembly 140 can further include a restoring member (not shown). The restoring member can be disposed on the base plate 110, located between the base plate 110 and the keycap 142, and located over the keyswitch circuit. When the keycap 142 is pressed downwards by an external force, the restoring member generates a counterforce to the keycap 142 so as to provide users the feeling of pressing. When the external force applied onto the keycap 142 is released, the restoring member can provide a restoring force for returning the keycap 142 back to its highest position at which the keycap 142 is not pressed. In some embodiments, the restoring member can be a resilient member, such as a rubber dome, a metal dome, or a spring plate. In practical applications, the restoring member can be other component having similar functions, such as a magnetic component.

As shown in FIGS. 3A and 3B, in the present embodiment, the base plate 110 has a through hole 112 running through the top surface 111. The hook structures 120 adjoin the through hole 112. Specifically, the hook structures 120 are bended from an inner wall of the through hole 112 toward a side of the top surface 111 of the base plate 110. In some embodiments, the base plate 110 and any of the hook structures 120 form two connected parts of a unitary structure. For example, a stamping process can be performed to a metal plate to simultaneously manufacture the base plate 110 having the through hole 112 and the hook structures 120 extending in the through hole 112. Afterwards, a bending process can be performed to bend the hook structures 120 toward a side of the top surface 111 of the base plate 110, so as to make the hook structures 120 be raised relative to the top surface 111 of the base plate 110.

In the embodiment as shown in FIGS. 3A and 3B, the hook structure 120 is embedded in the plastic engaging member 130 from a side surface of the plastic engaging member 130. For example, when the plastic engaging member 130 is formed on the hook structure 120 by an injection molding process, the side surface of the plastic engaging member 130 only covers at least a part of the hook structure 120. The hook structure 120 has a surface. The surface has a blocking portion 121. The blocking portion 121 substantially faces the base plate 110. A specific definition of the "substantially faces" means, for example, a normal line N (referring to FIG. 4) of the blocking portion 121 passes through the top surface 111 of the base plate 110 and a virtual extension surface V of the top surface 111 (i.e., the normal line N which passes through the through hole 112 also conforms to the definition). A part of the plastic engaging member 130 is located between the blocking portion 121 and the top surface 111. Therefore, as long as the plastic engaging member 130 covers the blocking portion 121 of the hook structure 120, the blocking portion 121 can prevent the part of the plastic engaging member 130 located between the blocking portion 121 and the top surface 111 from moving away from the top surface 111, so as to avoid the situation that the plastic engaging member 130 is removed from the hook structure 120 in the direction away from the base plate 110. In addition, because the plastic engaging member 130 is mainly fixed to the hook structure 120, the top surface 111 of the base plate 110 can remain flat.

In the embodiment as shown in FIGS. 3A and 3B, there are two hook structures 120 adjoining the through hole 112 and located at opposite sides of the through hole 112 respectively. For example, the two hook structures 120 are respectively located at two opposite corners of the through hole 112. In addition, the plastic engaging member 130 is fixed to the two hook structures 120 at the same time. Therefore, the plastic engaging member 130 can be more stably fixed on the base plate 110 and the drawing resistance can be enhanced, but the disclosure is not limited in this regard. In practical applications, only one hook structure 120 adjoins the through hole 112 and is fixed to the plastic engaging member 130, and the purpose of fixing the plastic engaging member 130 to the base plate 110 can still be achieved. In some embodiments, the two hook structures 120 which adjoin the through hole 112 can be located at the same side of the through hole 112. The plastic engaging member 130 is fixed to the two hook structures 120 at the same time, so as to fix the plastic engaging member 130 on the base plate 110.

In some embodiments, the hook structure 120 can also be extended from a bottom surface of the plastic engaging member 130 and embedded into the plastic engaging member 130, so as to increase the fixing strength between the hook structure 120 and the plastic engaging member 130.

In the embodiment as shown in FIGS. 3A and 3B, the plastic engaging member 130 has an engaging portion 131. The engaging portion 131 has a shape of a water drop hole and is configured to be pivotally connected to the rotating shaft of the guiding connection structure 141, but the disclosure is not limited in this regard. In some embodiments, the engaging portion 131 of the plastic engaging member 130 can also has a shape of a sliding chute and configured to be slidably connected to the sliding shaft of the guiding connection structure 141.

Figure 4:
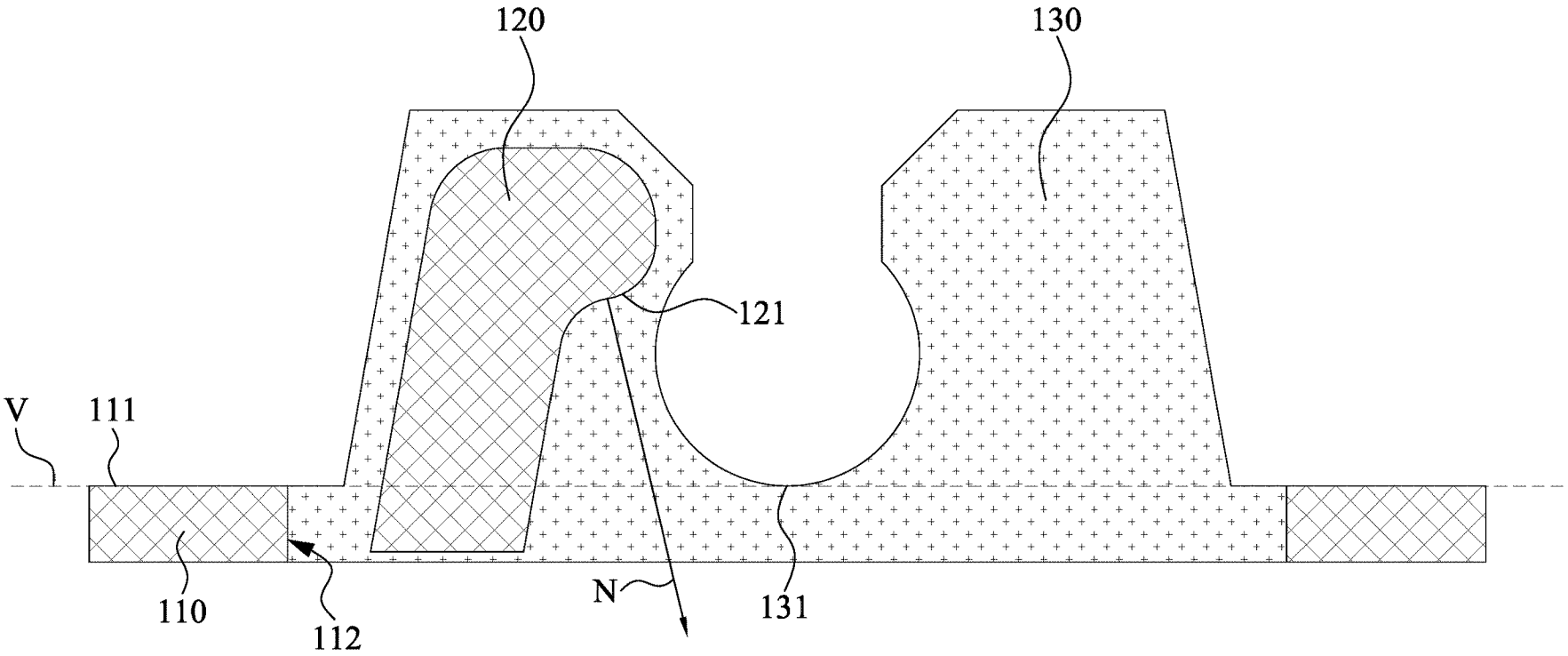
FIG. 4 is a cross-sectional view of the structure shown in FIG. 3A taken along line 4-4.

Reference is made to FIG. 4. FIG. 4 is a cross-sectional view of the structure shown in FIG. 3A taken along line 4-4. As shown in FIG. 4, in the present embodiment, the plastic engaging member 130 is partially extended into the through hole 112. In the embodiment as shown in FIG. 4, although the plastic engaging member 130 completely fills the through hole 112, the plastic engaging member 130 may only partially fill one or more specific positions (e.g., one or more edges or corners) in the through hole 112 in practical applications.

Figure 5:
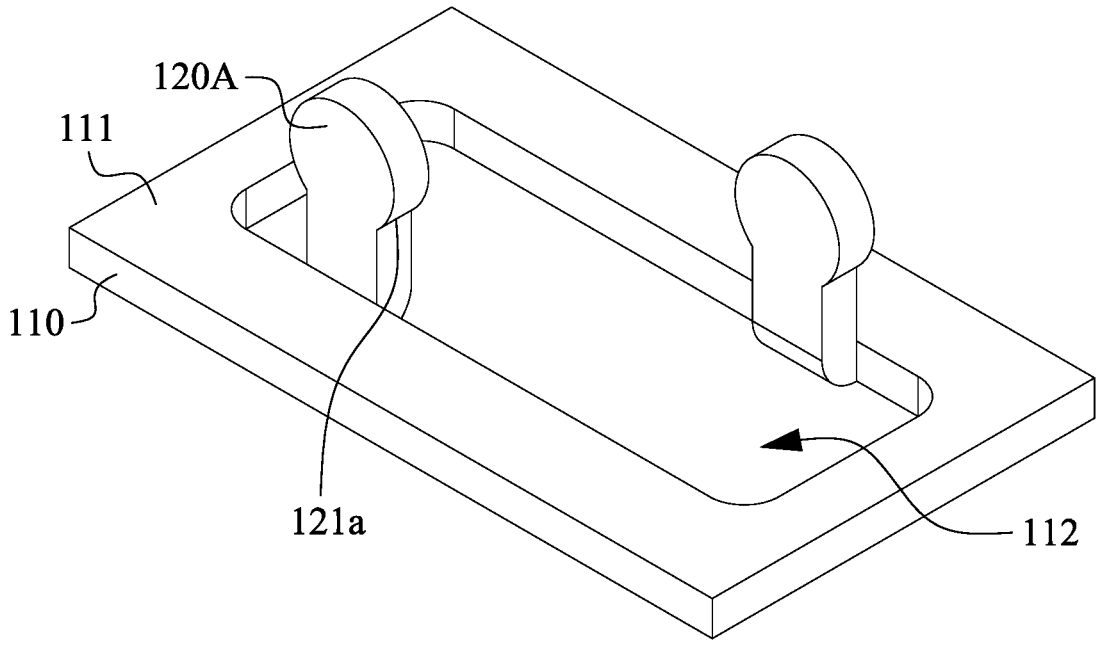
FIG. 5 is a perspective view of a part of the base plate and hook structures according to an embodiment of the disclosure.

Reference is made to FIG. 5. FIG. 5 is a perspective view of a part of the base plate 110 and hook structures 120A according to an embodiment of the disclosure. Compared to the embodiment as shown in FIG. 3B, ends of the hook structures 120A of the present embodiment have a relative round shape, and still have blocking portions 121*a* configured to block the plastic engaging member 130 and prevent the plastic engaging member 130 from being removed from the hook structures 120A in the direction away from the base plate 110.

Figure 6:
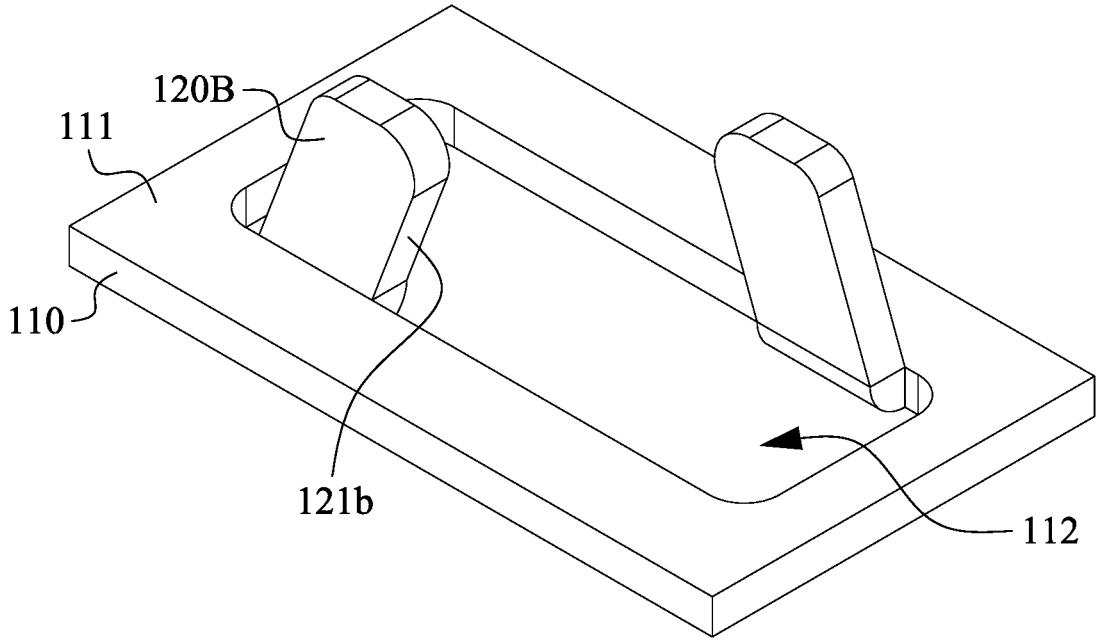
FIG. 6 is a perspective view of a part of the base plate and hook structures according to an embodiment of the disclosure.

Reference is made to FIG. 6. FIG. 6 is a perspective view of a part of the base plate 110 and hook structures 120B according to an embodiment of the disclosure. Compared to the embodiment as shown in FIG. 3B, the hook structures 120B of the present embodiment have a shape that is inclined relative to the base plate 110, and still have blocking portions 121*b* configured to block the plastic engaging member 130 and prevent the plastic engaging member 130 from being removed from the hook structures 120B in the direction away from the base plate 110.

Figure 7:
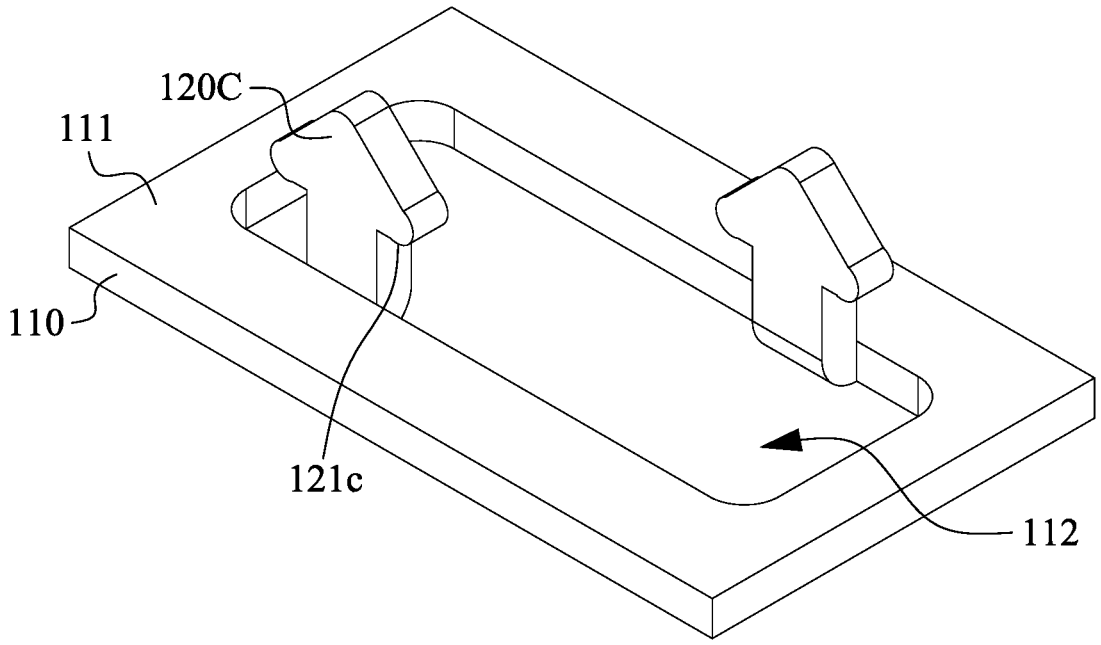
FIG. 7 is a perspective view of a part of the base plate and hook structures according to an embodiment of the disclosure.

Reference is made to FIG. 7. FIG. 7 is a perspective view of a part of the base plate 110 and hook structures 120C according to an embodiment of the disclosure. Compared to the embodiment as shown in FIG. 3B, ends of the hook structures 120C of the present embodiment have an arrow shape, and still have blocking portions 121*c* configured to block the plastic engaging member 130 and prevent the plastic engaging member 130 from being removed from the hook structures 120C in the direction away from the base plate 110. Moreover, each of the hook structures 120C of the present embodiment has two blocking portions 121*c* respectively located on opposite sides, thereby increasing the area of the blocking portions 121*c* and having better effect of preventing the plastic engaging member 130 from being removed.

Figure 8:
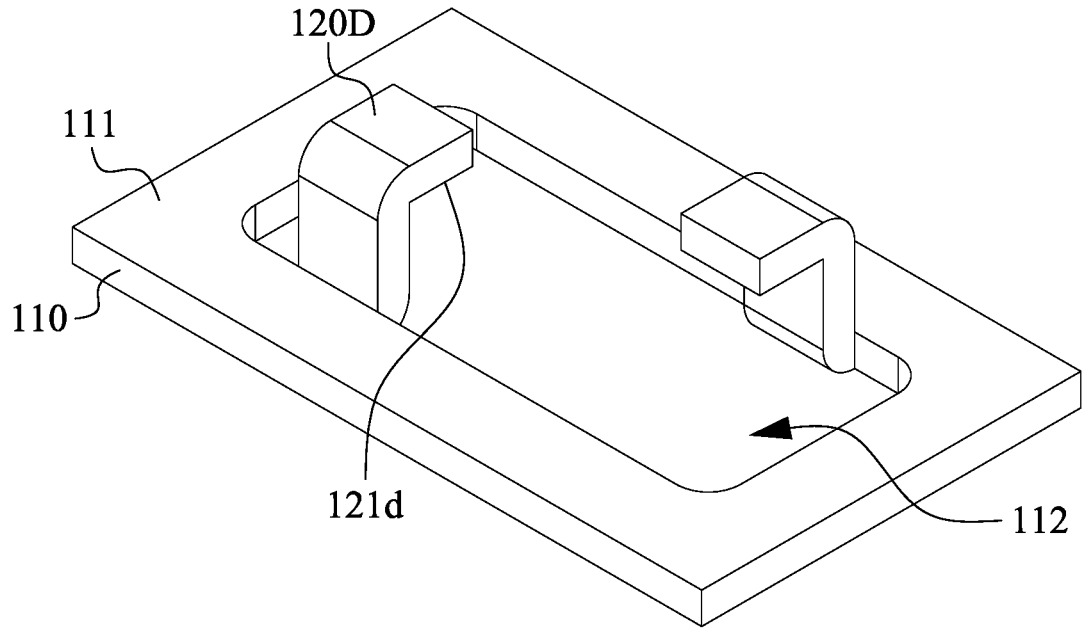
FIG. 8 is a perspective view of a part of the base plate and hook structures according to an embodiment of the disclosure.

Reference is made to FIG. 8. FIG. 8 is a perspective view of a part of the base plate 110 and hook structures 120D according to an embodiment of the disclosure. Compared to the embodiment as shown in FIG. 3B, the hook structures 120D of the present embodiment still have blocking portions 121*d* configured to block the plastic engaging member 130 and prevent the plastic engaging member 130 from being removed from the hook structures 120D in the direction away from the base plate 110. In particular, the hook structure 120D of the present embodiment adjoins one side edge of the through hole 112 and rises relative to the surface of the base plate 110 and extends toward another opposite side edge of the through hole 112, thereby increasing the area of the blocking portions 121*d* and having better effect of preventing the plastic engaging member 130 from being removed.

Figure 9:
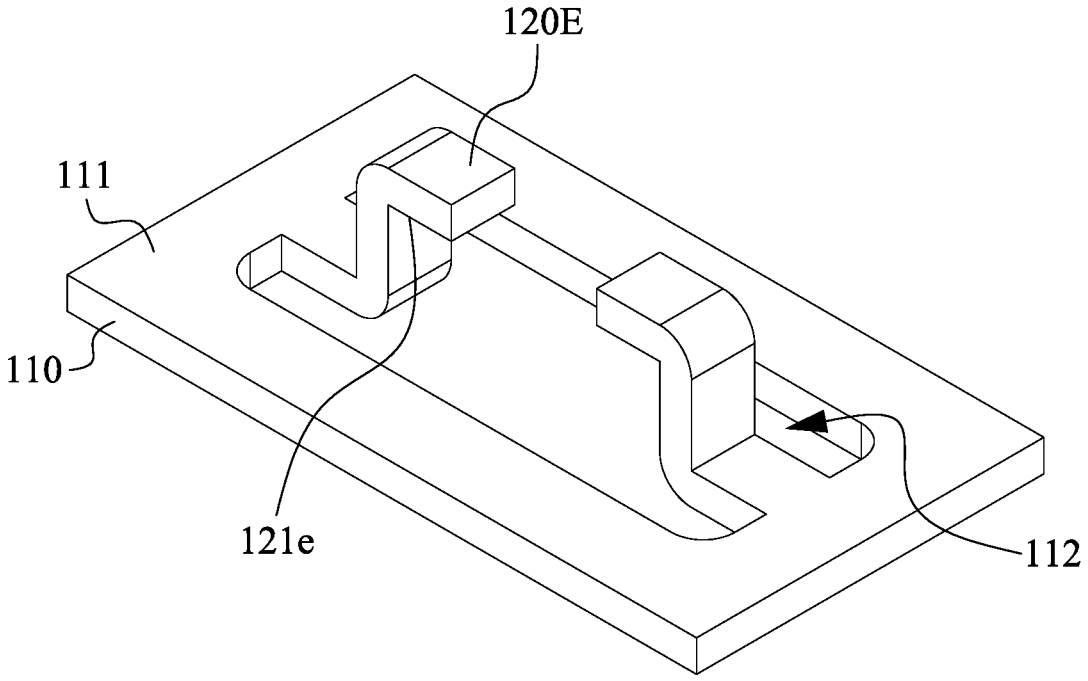
FIG. 9 is a perspective view of a part of the base plate and a hook structure according to an embodiment of the disclosure.

Reference is made to FIG. 9. FIG. 9 is a perspective view of a part of the base plate 110 and hook structures 120E according to an embodiment of the disclosure. Compared to the embodiment as shown in FIG. 3B, the hook structures 120E still have blocking portions 121*e* configured to block the plastic engaging member 130 and prevent the plastic engaging member 130 from being removed from the hook structures 120E in the direction away from the base plate 110. In addition, compared to the hook structures 120D of the embodiment as shown in FIG. 8, the hook structures 120E of the present embodiment additionally include portions extending in the through hole 112, thereby increasing the area where the hook structures 120E are fixed to the plastic engaging member 130 and having better fixing strength therebetween. Furthermore, the hook structures 120E of the present embodiment have more bending points, so the structural strength can also be improved (e.g., stress concentration occurs after multiple bending processes).

Figure 10:
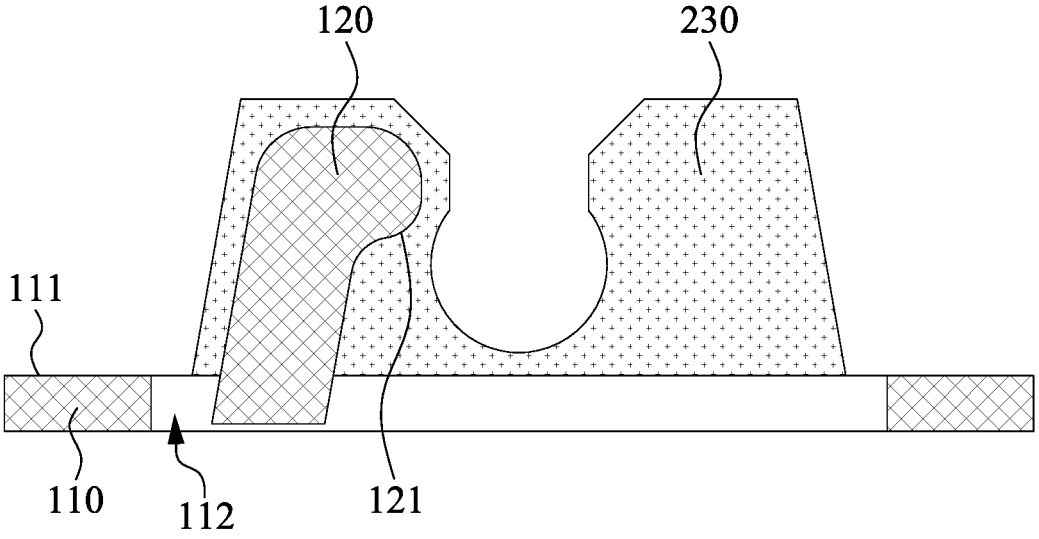
FIG. 10 is a cross-sectional view of a part of the base plate, the hook structure, and a plastic engaging member according to an embodiment of the disclosure.

Reference is made to FIG. 10. FIG. 10 is a cross-sectional view of a part of the base plate 110, the hook structure 120, and a plastic engaging member 230 according to an embodiment of the disclosure. As shown in FIG. 10, in the present embodiment, the base plate 110 and the hook structure 120 are identical or similar to those of the embodiment as shown in FIG. 3B, so introductions of the two components can be referred to the related description above and will not be repeated here. It should be pointed out that compared to the embodiment as shown in FIG. 4, the plastic engaging member 230 of the present embodiment is entirely located outside the through hole 112. That is to say, any part of the plastic engaging member 230 is not filled into the through hole 112, but the purpose of fixing the plastic engaging member 230 to the hook structure 120 can still be achieved. Because the plastic engaging member 230 is only fixed to the hook structure 120, the top surface 111 of the base plate 110 can remain flat. In the embodiment as shown in FIG. 10, the bottom surface of the plastic engaging member 230 is flush with the top surface 111 of the base plate 110, but the disclosure is not limited in this regard. In practical applications, the bottom surface of the plastic engaging member 230 can also be above the top surface 111 of the base plate 110. In addition, in the embodiment as shown in FIG. 10, the plastic engaging member 230 and the base plate 110 do not adjoin each other, but the disclosure is not limited in this regard. In practical application, the plastic engaging member 230 can also adjoin the top surface 111 of the base plate 110, so as to increase the structural stability of the plastic engaging member 230 on the base plate 110.

Figure 11:
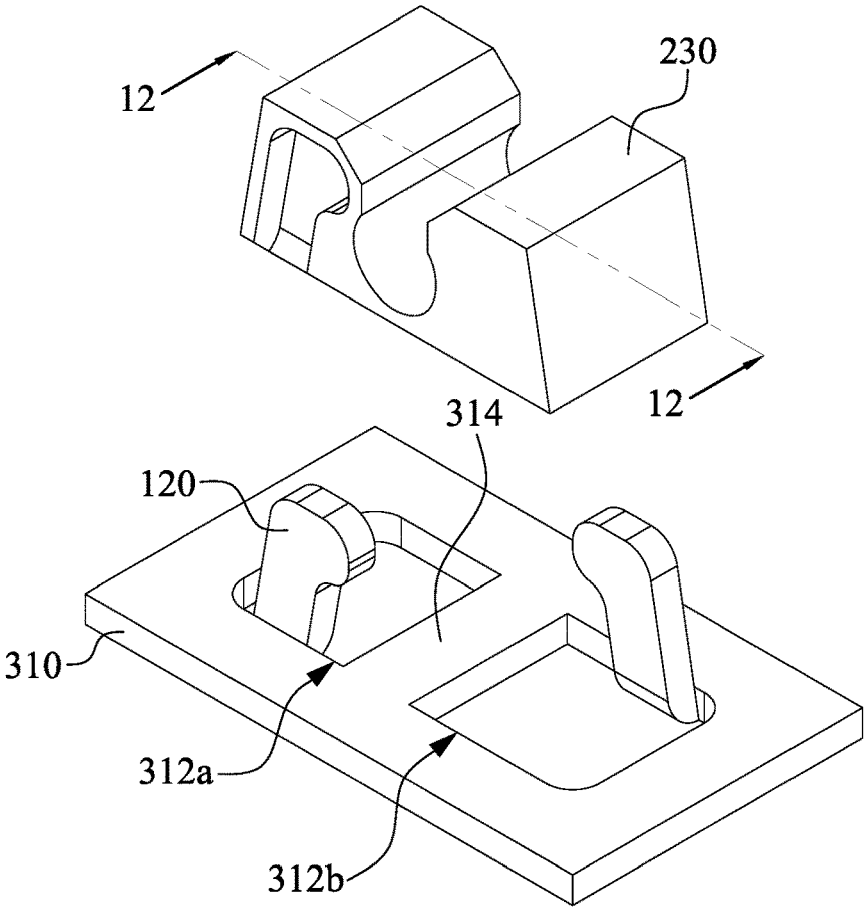
FIG. 11 is an exploded view of a part of a base plate, the hook structure, and the plastic engaging member according to an embodiment of the disclosure.
Figure 12:
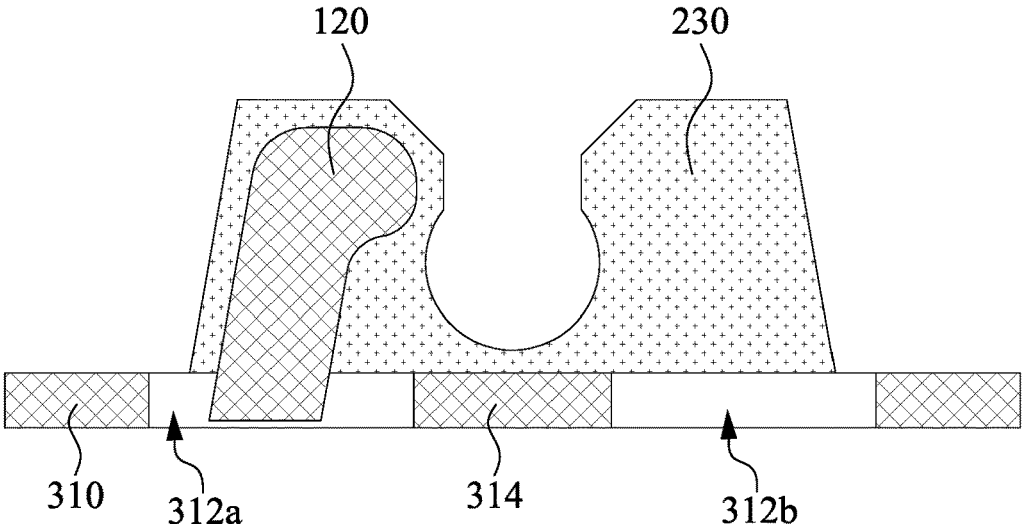
FIG. 12 is a cross-sectional view of the structure shown in FIG. 11 taken along line 12-12.

Reference is made to FIGS. 11 and 12. FIG. 11 is an exploded view of a part of a base plate 310, the hook structures 120, and the plastic engaging member 230 according to an embodiment of the disclosure. FIG. 12 is a cross-sectional view of the structure shown in FIG. 11 taken along line 12-12. As shown in FIGS. 11 and 12, in the present embodiment, the hook structure 120 is identical or similar to that of the embodiment as shown in FIG. 3B, and the plastic engaging member 230 is identical or similar to that of the embodiment as shown in FIG. 10, so introductions of the two components can be referred to the related description above and will not be repeated here. It should be pointed out that compared to the embodiment as shown in FIG. 3B, the base plate 310 of the present embodiment has two through holes 312*a*, 312*b* and a rib 314 separating the two through holes 312*a*, 312*b*. In addition, the two hooks structures 120 adjoin the two through holes 312*a*, 312*b* respectively. The plastic engaging member 230 is fixed to the two through holes 312*a*, 312*b* at the same time. The rib 314 is configured to support the bottom of the plastic engaging member 230 from below, so as to improve the structural stability of the combination of the base plate 310, the hook structure 120, and the plastic engaging member 230. In the present embodiment, the plastic engaging member 230 is entirely located outside the through holes 312*a*, 312*b*, but the disclosure is not limited in this regard. In some embodiments, the plastic engaging member 230 may also partially fill one or more positions (e.g., one or more edges or corners) in the through holes 312*a*, 312*b*.

According to the foregoing recitations of the embodiments of the disclosure, it can be seen that in the keyboard of the present disclosure, the guiding connection structure is connected to the plastic engaging member disposed on the base plate, instead of, in the conventional keyboard, being connected to the hooks on the metal bottom plate. The plastic engaging member disposed on the base plate of the present disclosure can increase the structural strength of the base plate, so as to effectively avoid the problem of deformation of the base plate caused by pressing when assembling the guiding connection structure or pressing the keycap, thereby allowing the base plate to be further thinned to achieve the purpose of being light and thin. Moreover, the assembly tolerance between the plastic engaging member and the guiding connection structure can be controlled simply by the manufacturing precision of the plastic engaging member itself, and does not be deeply affected by the processing precision of bending the hooks as the conventional keyboard does, so the assembly precision of the keyboard of the present disclosure is improved.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A keyboard, comprising:

a base plate having a top surface and a through hole running through the top surface;

a hook structure connected to the base plate and raised relative to the top surface;

a plastic engaging member located on the top surface and fixed to at least a part of the hook structure, wherein the plastic engaging member is in contact with an edge of the through hole;

a keyswitch assembly comprising a guiding connection structure and a keycap, the guiding connection structure being engaged between the plastic engaging member and the keycap, and configured to guide the keycap to move toward and away from the base plate, wherein the guiding connection structure comprises a pair of pivotally interconnected linkages that are in contact with each other, and the pivotally interconnected linkages comprise a rotating shaft; and another hook structure connected to the base plate and raised relative to the top surface;

wherein the plastic engaging member defines an engaging portion which is formed as a cavity, and the engaging portion receives the rotating shaft of the guiding structure;

wherein the plastic engaging member comprises a first engaging piece, a second engaging piece, and a bottom section, each of the first and second engaging pieces extending upwardly from the bottom section, and wherein the engaging portion is defined among the first engaging piece, the second engaging piece, and the bottom section;

wherein said hook structure is embedded in the first engaging piece and said another hook structure is embedded in the second engaging piece;

wherein the base plate has a bottom surface opposite the top surface, and the engaging portion, which is formed as a cavity defined among the first engaging piece, the second engaging piece, and the bottom section, opens upwardly in a direction away from the bottom surface of the base plate.

2. The keyboard of claim 1, wherein the hook structure adjoins the through hole.

3. The keyboard of claim 2, wherein the plastic engaging member is partially extended into the through hole.

4. The keyboard of claim 2, wherein the plastic engaging member is entirely located outside the through hole.

5. The keyboard of claim 1, wherein said another hook structure adjoins the through hole, and the hook structure and said another hook structure are located at opposite sides of the through hole respectively.

6. The keyboard of claim 1, wherein the base plate further has another through hole running through the top surface, and said another hook structure adjoins said another through hole.

7. The keyboard of claim 6, wherein the base plate further has a rib, and the rib separates the through hole and said another through hole and supports the plastic engaging member.

8. The keyboard of claim 1, wherein the hook structure is embedded in the plastic engaging member.

9. The keyboard of claim 1, wherein the hook structure has a surface having a blocking portion, the blocking portion substantially faces the base plate, and a part of the plastic engaging member is located between the blocking portion and the top surface.

10. The keyboard of claim 9, wherein a normal line of the blocking portion passes through the top surface of the base plate and a virtual extension surface of the top surface.

11. The keyboard of claim 1, wherein the base plate and the hook structure form two connected parts of a unitary structure.

12. The keyboard of claim 1, wherein the hook structure is bended from the base plate.

13. The keyboard of claim 1, further comprising:

a keycap located over the base plate; and a guiding connection structure engaged between the plastic engaging member and the keycap and configured to guide the keycap to move toward and away from the base plate.

14. The keyboard of claim 1, wherein said hook structure and said another hook structure are located respectively at opposite sides of the through hole.

15. The keyboard of claim 14, wherein the through hole is substantially rectangular in shape, said hook structure is located at a first corner of the through hole, and said another hook structure is located at a second corner of the through hole diagonally located from the first corner.

16. The keyboard of claim 1, wherein an innermost portion of the engaging portion defined by the bottom section is substantially level with the top surface of the base plate.

17. The keyboard of claim 1, wherein the edge of the through hole is on the top surface.

18. A keyboard, comprising:

a base plate having a top surface and a through hole running through the top surface;

a hook structure connected to the base plate and raised relative to the top surface, wherein the hook structure adjoins the through hole;

a plastic engaging member located on the top surface and fixed to at least a part of the hook structure; and another hook structure connected to the base plate and raised relative to the top surface, wherein the plastic engaging member is further fixed to said another hook structure;

wherein the base plate further has a rib and another through hole running through the top surface, said another hook structure adjoins said another through hole, and the rib separates the through hole and said another through hole and supports the plastic engaging member.

* * * * *